United States Patent [19]

Smith

[11] 4,312,535

[45] Jan. 26, 1982

[54] CLAMP MOUNTED FOLDABLE PORTABLE BABY CHAIR

[76] Inventor: Robert D. Smith, 3758 E. Winegar Rd., Bancroft, Mich. 48414

[21] Appl. No.: 150,249

[22] Filed: May 16, 1980

[51] Int. Cl.[3] ..... A47B 39/00

[52] U.S. Cl. ..... 297/174; 297/134

[58] Field of Search ..... 297/174, 134

[56] References Cited

U.S. PATENT DOCUMENTS

| | | | |
|---|---|---|---|
| 2,509,036 | 5/1950 | Cox et al. | 297/174 |
| 2,707,987 | 5/1955 | Gibson | 297/174 |
| 3,133,760 | 5/1964 | Robinson | 297/174 |
| 3,222,104 | 12/1965 | Remington et al. | 297/174 |
| 3,243,229 | 3/1966 | Barnhill | 297/134 |
| 3,397,010 | 8/1968 | Leimgruber | 297/174 |
| 3,994,529 | 11/1976 | Lippert | 297/134 X |
| 4,230,362 | 10/1980 | Euwema | 297/174 |
| 4,284,478 | 2/1981 | Aron | 297/174 |

*Primary Examiner*—Ramon S. Britts
*Assistant Examiner*—Peter A. Aschenbrenner
*Attorney, Agent, or Firm*—Miller, Morriss & Pappas

[57] ABSTRACT

A clamp mounted foldable portable baby chair is provided having a pair of spaced-apart substantially U-shaped elongate clamp support members having upper and lower support arm extensions which are adapted to clampably engage a table top therebetween. A horizontally oriented seat bottom member is pivotally suspended below the spaced-apart clamp support members by use of pivotal support links. The seat bottom member is selectively retractable to a horizontal storage position between the clamp support members. A vertically oriented seat back member is pivotally connected along the lower edge thereof to the rear edge of the seat bottom member. The seat back member extends upwardly between the spaced-apart clamp support members at the rear portions thereof and the seat back member is pivotally connected at the sides thereof to the lower support arm extensions proximate to the U-shaped portions of the clamp support members. The seat back member is selectively foldable forwardly to a horizontally oriented storage position between the spaced-apart clamp support members upon corresponding retractive movement of the seat bottom member to a retracted storage position thereagainst. Adjustment lock arm means are provided in association with the seat bottom member and the seat back member so as to provide for selective locking adjustment thereof into various operative use positions in relation to the clamp support members.

5 Claims, 8 Drawing Figures

CLAMP MOUNTED FOLDABLE PORTABLE BABY CHAIR

SUMMARY OF THE INVENTION

This invention relates to a clamp mounted foldable portable baby chair having spaced-apart clamp support members having biased support arm extensions and which is adapted to be selectively clamp mounted to a table top without the need for ancillary clamping and/or locking means for attachment to the table top in its operative use position. This invention further relates to a foldable portable baby chair which is provided with seat bottom and seat back members which are pivotally interconnected with each other and with the clamp support members so that the seat back and seat bottom members can be selectively adjusted to various use positions relative to each other or folded into an abutting flat storage position between the clamp support members. The baby chair is comprised of a pair of spaced-apart substantially U-shaped elongate clamp support members having upper and lower support arm extensions which are adapted to clampably engage a table top. A plurality of downwardly depending spaced-apart support links are pivotally connected at the upper ends thereof to each of the lower support arm extensions. A horizontally oriented seat bottom member is pivotally connected along the sides thereof to the lower ends of the support links so as to be suspended below the spaced-apart clamp support members. The seat bottom member is selectively retractable to a horizontal storage position between the clamp support members upon corresponding movement of the support links. A vertically oriented seat back member is pivotally connected along the lower edge thereof to the rear edge of the seat bottom member. The seat back member extends upwardly between the spaced-apart clamp support members at the rear portions thereof. The seat back member is pivotally connected at the sides thereof to the lower support arm extensions proximate to the U-shaped portions of the clamp support members. The seat back member is selectively foldable forwardly to a horizontally oriented storage position between the spaced-apart clamp support members while causing corresponding movement of the seat bottom member to a retracted storage position thereagainst. An arcuate adjustment lock arm is pivotally connected at the lower end thereof to the seat bottom member at one of its pivotal connections to the lower support arm extension and is provided with a plurality of positioning adjustment notches which are adapted to selectively engage the seat back member at one of its pivotal connection points to the lower support arm extension so as to fixedly maintain the seat back and seat bottom members in any desired position relative to each other and to the clamp support members. The adjustment lock arm can be selectively disengaged to permit selective pivotal movement of the seat back member to a horizontal storage position between the spaced-apart clamp support members while simultaneously drawing the seat bottom member into an abutting storage position thereagainst.

IN THE DRAWINGS

DESCRIPTION

Figure 2:
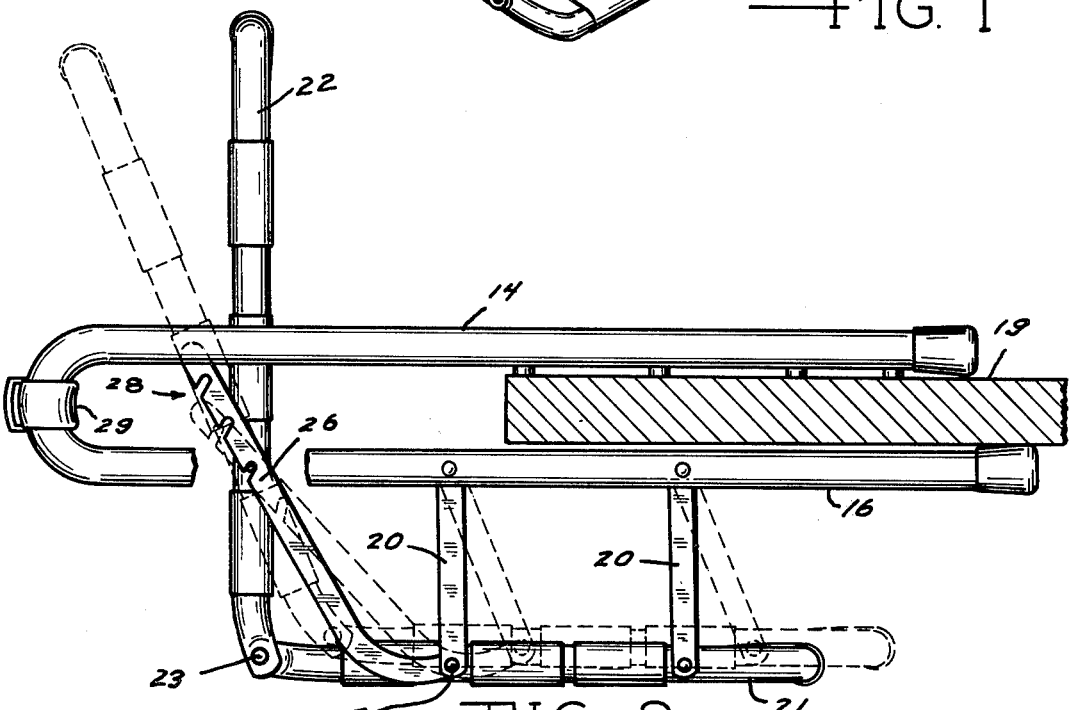
FIG. 2 is a side schematic view of the baby chair showing the upper and lower support arm extensions in clamped engagement with a table top and further showing in phantom-line the baby chair with the seat back portion in its rearwardly inclined position.

As shown in the drawings, the clamp-mounted foldable portable baby chair 11 is provided with a pair of spaced-apart substantially U-shaped elongate clamp support members 12 and 13, respectively. Each of the clamp support members 12 and 13 are provided with upper support arm extensions 14 and 15, respectively, and with lower support arm extensions 16 and 17, respectively. Rubber grip members 18 are provided along the bottom of the upper arm extensions 14 and 15 so as to facilitate engagement with the upper surface of a table top 19 as shown in FIG. 2. The U-shaped clamp support members 12 and 13 are fabricated from resilient tubular material. The upper and lower arm extensions of each support member are resiliently biased toward each other so as to enhance the clamping force against the table top inserted therebetween. In use, the baby chair is easily mounted into its operative use position on the table top by pulling the upper and lower support arms slightly apart and positioning the table top therebetween as shown in FIG. 2. As shown, the baby chair is thus retained in its use position on the table top without the need for ancillary locking means. The clamping pressure exerted by the arm extensions against the table top safely retains the baby chair in its use position. The baby chair can be easily removed by merely pulling the support members 12 and 13 away from and thus, out of engagement with the table top.

In the preferred embodiment of the invention, a pair of spaced-apart downwardly depending support links 20 are pivotally connected at the upper ends thereof to the lower support arm extensions 16 and 17, respectively. Horizontally oriented bottom member 21 is pivotally suspended beneath the lower support arms 16 and 17 by being pivotally connected to the lower ends of the support links 20. The seat bottom member 21 can be selectively retracted to a storage position between the clamp support members. A vertically oriented seat back member 22 is pivotally connected to the seat bottom member 21 by use of a seat connector rod 23. The seat bottom and seat back members are fabricated from aluminum tubular stock but can be unitarily formed by any other suitable material such as plastic. In the preferred embodiment, interwoven plastic strip material 24 is utilized to form the bodies of the seat and back members. Here again, the back and seat members can be unitarily formed from plastic.

The seat back member 22 is pivotally mounted at the sides thereof between the U-shaped support members by use of connector pins 25 which extend through the respective lower support arm and the tubular side portion of the seat back member proximate thereto.

The seat back member 22 is pivotally mounted at the sides thereof between the U-shaped support members by use of connector pins 25 which extend through the respective lower support arm and the tubular side portion of the seat back member proximate thereto.

Figure 1:
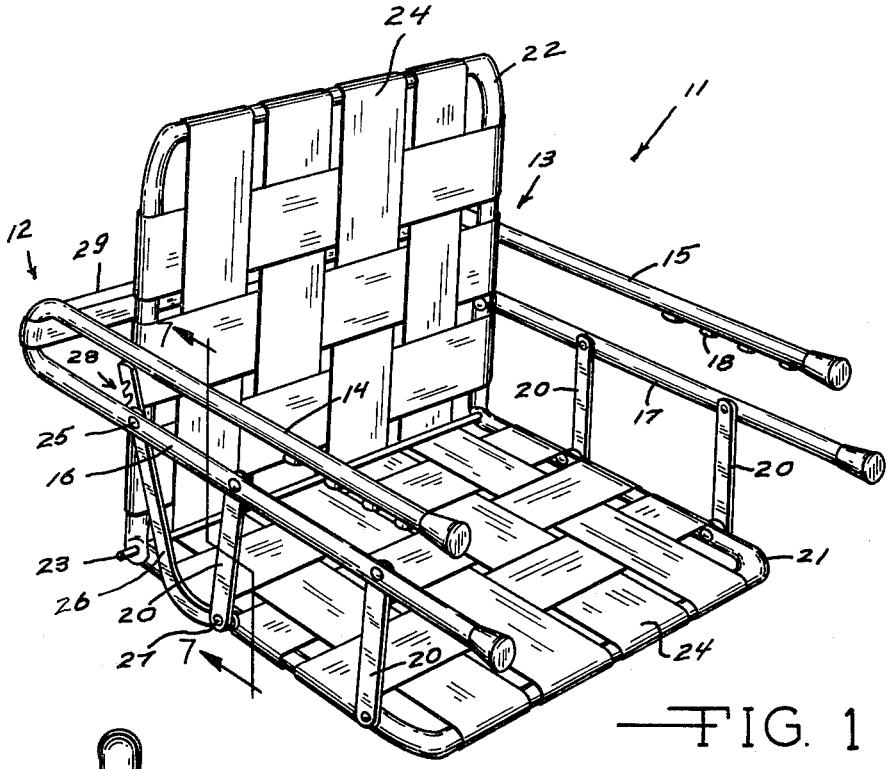
FIG. 1 is a left perspective view of the clamp mounted foldable portable baby chair.
Figure 6:
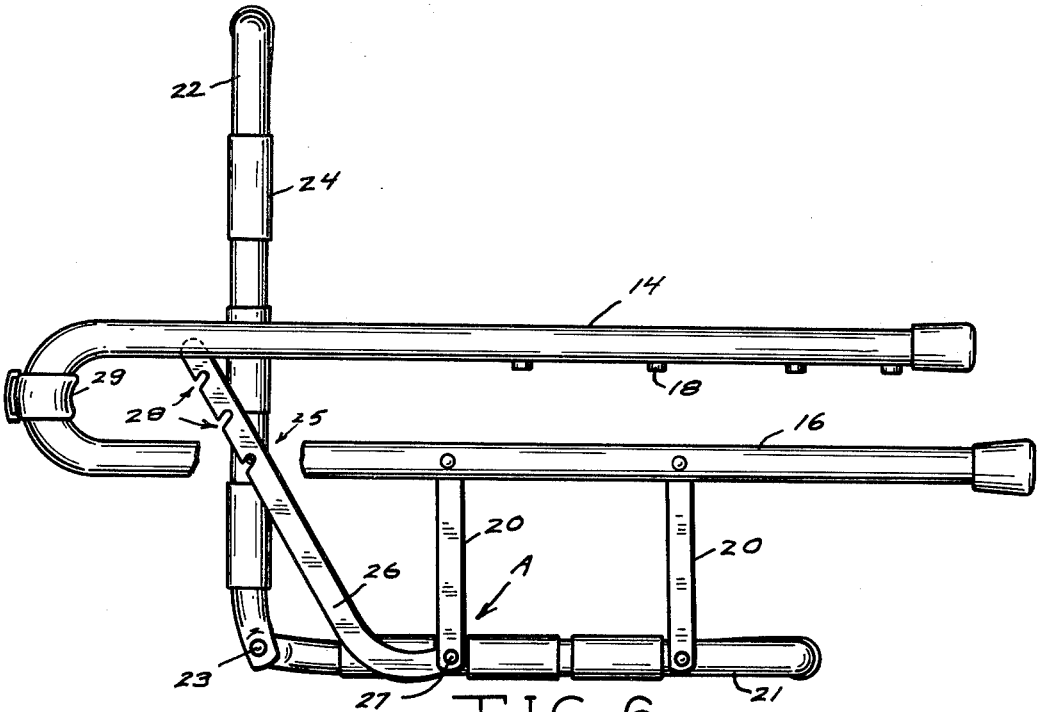
FIG. 6 is a side schematic view of the baby chair with lower support arm broken away to show the adjustment lock arm in locked engagement with the seat back pivotal connection rod.
Figure 7:
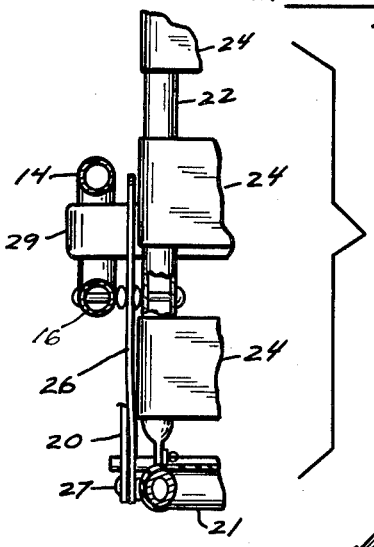
FIG. 7 is a partial sectional view of the baby chair taken on line 7—7 of FIG. 1.

An arcuate adjustment lock arm 26 is provided which is pivotally connected at one end thereof to the link connector pin 27 intermediate the side of the seat bottom member and the lower support arm extension 16 at point A. A plurality of back-adjustment notches 28 are provided proximate to the opposite end of the lock arm 26. The notches 28 are adapted to selectively engage the seat back support pin 25 intermediate the side of the seat back member and the lower support arm extension 16. Thus, the adjustment lock arm 26 can be selectively engaged with pin 25 so as to maintain the seat back member 22 in a vertical upright fixed position relative to the seat bottom member 21 as shown in FIGS. 1, 2 and 6. An alternate rearwardly slanted position of the seat back member 22 is shown in phantom-line in FIG. 2. As also shown in phantom-line in FIG. 2, the seat bottom member 21 and support links 20 are correspondingly moved to their positions shown in phantom-line upon corresponding pivotal movement of the seat back member 22.

Figure 3:
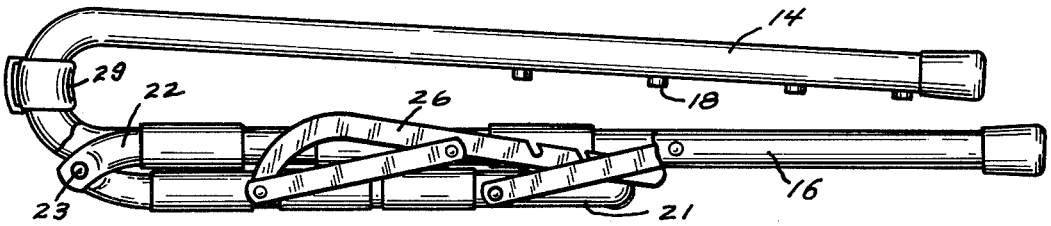
FIG. 3 is a side schematic view of the baby chair with the lower support arm broken away to show the seat back and seat bottom members in their folded storage position.
Figure 4:
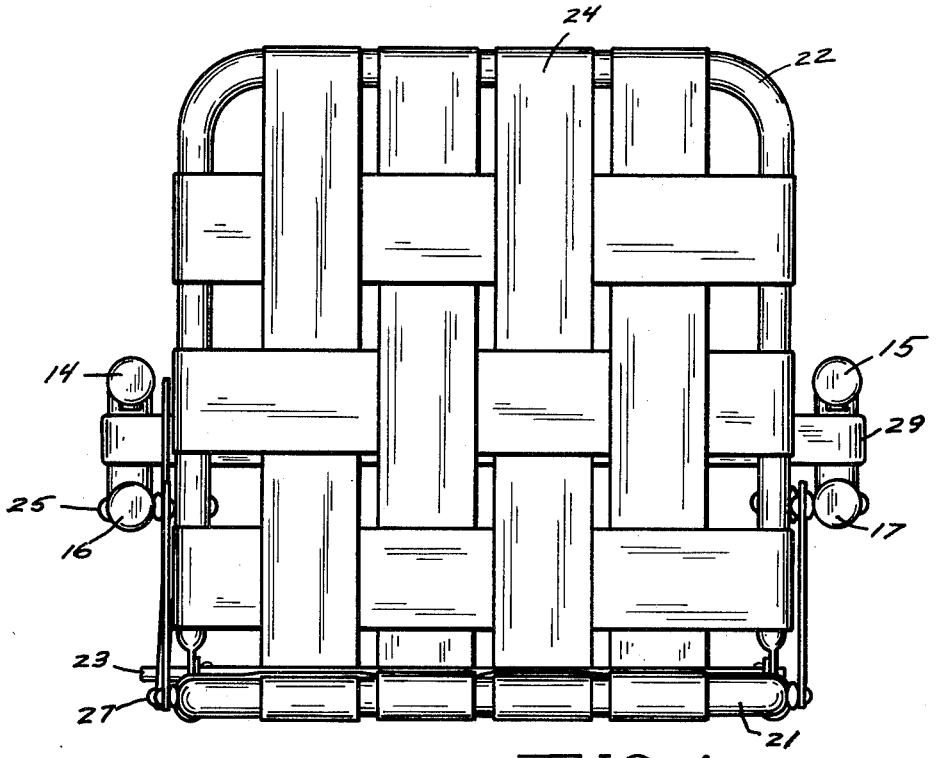
FIG. 4 is a front elevational view of the baby chair.
Figure 5:
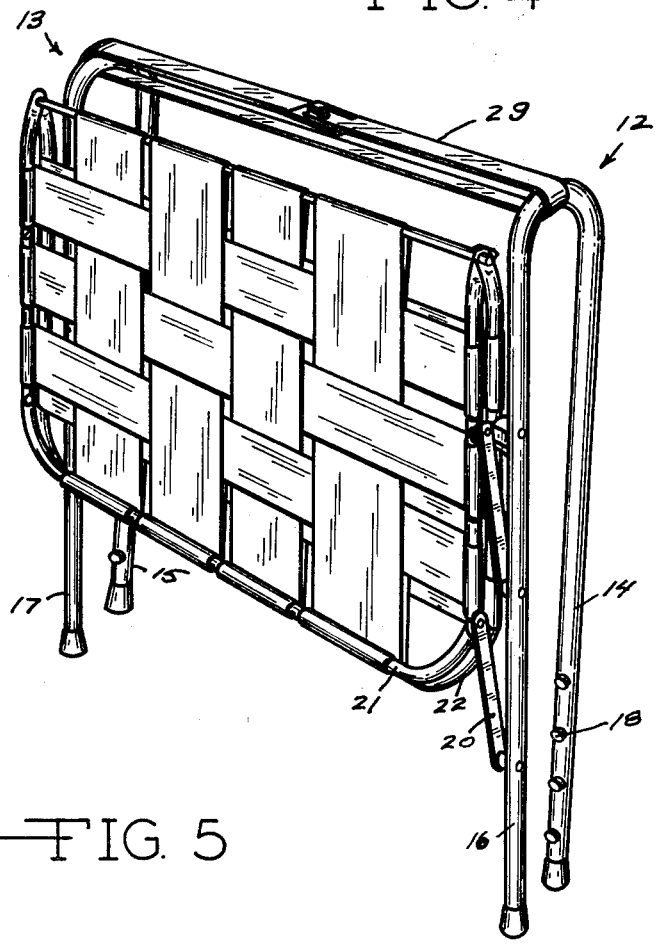
FIG. 5 is a perspective view of the baby chair in its folded storage carrying position.
Figure 8:
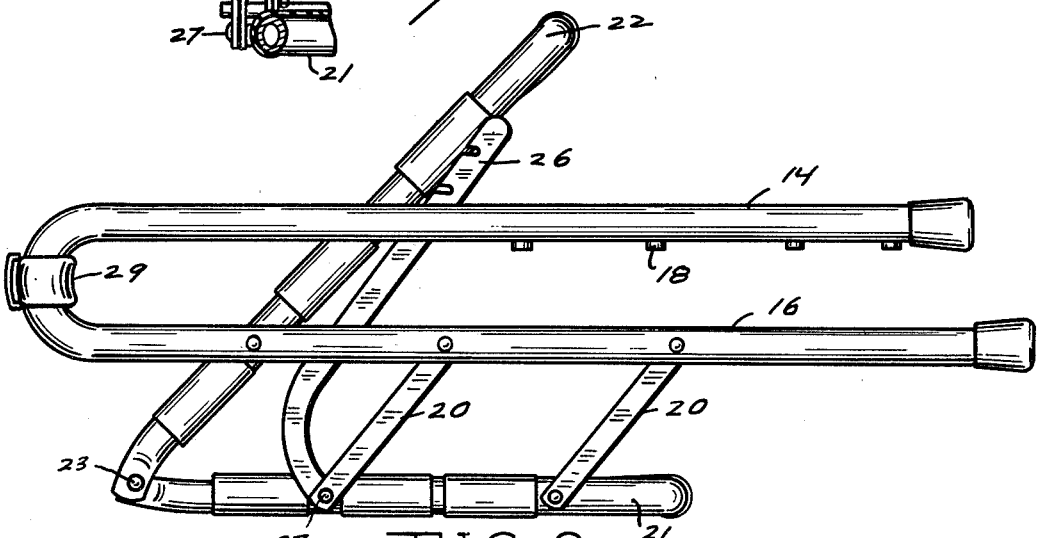
FIG. 8 is a side schematic view of the baby chair showing the seat back, seat bottom and adjustment lock arm in an intermediate position between their extended use position and their folded retracted storage position.

When the baby chair is not in use, it is disengaged from the table top. The adjustment lock arm 26 is disengaged from the connector pin 25 and is pivotally moved forwardly and downwardly against the lower support arm as shown in FIGS. 3, 5 and 8. As further shown in FIG. 8, the seat back member 22 is pivoted forwardly and downwardly so as to lie between the U-shaped support members approximately within the plane established by the lower support arm extensions 16 and 17. Upon such movement by the seat back member 22, the seat member 21 correspondingly moves rearwardly and upwardly into its retracted storage position against the seat back member 22 as shown in FIGS. 3, 5 and 8.

A carrying strap 29 is provided in engagement with the U-portions of the spaced-apart support members so that the baby chair can be easily carried in the position shown in FIG. 5.

It is thus seen that a highly utilitarian clamp-mounted foldable portable baby chair assembly is provided which can be easily mounted upon a table top without the need for ancillary clamping or locking means. Further, a baby chair assembly is provided which can easily be folded to a storage position between the U-shaped spaced-apart support members forming a part of the baby chair assembly so as to provide ease of storage and transport.

Various other modifications of the invention may be made without departing from the principle thereof. Each of the modifications is to be considered as included in the hereinafter appended claims, unless these claims by their language expressly provide otherwise.

I claim:

1. A clamp mounted mounted foldable portable baby chair for selective mounting upon a table top comprising:

a pair of spaced-apart substantially U-shaped elongate clamp support members having upper and lower horizontal support arm extensions adapted to clampably engage a table top therebetween;

at least one downwardly depending spaced-apart support link pivotally connected at the upper end thereof to each of said lower support arm extensions of said spaced-apart clamp support members;

a horizontally oriented seat bottom member pivotally connected along the sides thereof to the lower ends of said support links so as to be suspended below said spaced-apart clamp support members, said seat bottom member selectively retractable to a horizontal storage position between said clamp support members upon corresponding movement of said support links; and a vertically oriented seat back member pivotally connected along the lower edge thereof to the rear edge of said seat bottom member, said seat back member extending upwardly between said spaced-apart clamp support members, said seat back member pivotally connected at the sides thereof to said lower support arm extensions proximate to said U-shaped portions of said clamp support members, said seat back member selectively foldable forwardly to a horizontally oriented storage position between said spaced-apart clamp support members while causing corresponding movement of said seat bottom member to a retracted storage position thereagainst.

2. In the clamp mounted foldable portable baby chair of claim 1 wherein the adjustment lock arm means comprise an arcuate lock arm pivotally connected at the lower end thereof at the pivotal connection point between one of said support links and said seat bottom member, said arcuate lock arm provided with a plurality of positioning notches adapted for selective engagement with said seat back member at its corresponding pivotal connection with one of said clamp support members.

3. In the clamp mounted foldable portable baby chair of claim 1 wherein said upper and lower support arm extensions are biased toward each other so as to exert a clamping pressure against a table top mounted therebetween.

4. In the clamp mounted foldable portable baby chair of claim 1 wherein strap carrying means are provided in association with the U-shaped portions of the spaced apart clamp support members.

5. In the clamp mounted foldable baby chair of claim 1 wherein adjustment lock arm means are provided in association with said seat bottom member and said seat back member so as to provide for selective locking adjustment thereof to various operative use positions in relation to said clamp support members.

* * * * *